US006089004A

United States Patent [19]

Hsi-Chang et al.

[11] Patent Number: 6,089,004

[45] Date of Patent: Jul. 18, 2000

[54] SWIVELED-EYE HINGED-FOOT SAFETY STIRRUP

[75] Inventors: Chang Hsi-Chang, Taichung, Taiwan; David A. Robart, Elizabeth, Colo.

[73] Assignee: Eastwest International (Taiwan) Enterprises, Taichung, Taiwan

[21] Appl. No.: 09/143,169

[22] Filed: Aug. 28, 1998

[51] Int. Cl.[7] ..... B68C 3/02

[52] U.S. Cl. ..... 54/49

[58] Field of Search ..... 54/47, 49, 49.5

[56] References Cited

U.S. PATENT DOCUMENTS 281,861 7/1883 Ganzhorn ..... 54/49.5 X 606,368 6/1898 Thorn ..... 54/49

608,605 8/1898 House ..... 54/49 X 1,238,584 8/1917 Smith ..... 54/49

*Primary Examiner*—Robert P. Swiatek

*Attorney, Agent, or Firm*—Antonio R. Durando

[57] ABSTRACT

A stirrup has a pair of arms, an eye on the arms for receiving a strap, and a foot on the arms for supporting the foot of a rider. The eye and the foot of the stirrup are rotatable relative to the arms. The arms define a plane and the upper surface of the foot of the stirrup is perpendicular to this plane in one terminal position of the foot of the stirrup. The foot of the stirrup can only rotate backwards from this position. The eye has an opening for a strap, and the eye is freely rotatable relative to the arms through an angle of 90 degrees to and from a position in which the opening is coplanar with the arms.

10 Claims, 6 Drawing Sheets

SWIVELED-EYE HINGED-FOOT SAFETY STIRRUP

BACKGROUND OF THE INVENTION

1. Field of the Invention

The invention relates to a stirrup.

2. Description of the Prior Art

A stirrup consists of a pair of curved arms which serve as a carrier for an eye and a foot. Each arm is joined to the other at one end while the opposite ends of the arms are spaced from one another. The eye is located at the joint and the foot is disposed between the spaced ends of the arms.

The stirrup is secured to a horse by passing a strap through the eye which then serves as a holding member for the strap. The arms and the foot can rotate relative to the eye between a position in which the eye is coplanar with the arms and positions in which the eye is transverse to the arms. This allows the eye to be oriented such that the strap is flat against the horse and flat against the leg of a rider. At the same time, the arms and the foot can be properly positioned for the foot of the rider.

The foot of the stirrup can rotate relative to the arms on an axis extending between the spaced ends of the arms. The foot is rotatable forwards and backwards from a central position in which a plane defined by the arms is perpendicular to the tread of the foot. The primary reason for rotation of the foot is safety. Thus, should the rider fall off the horse backwards, the foot of the stirrup can rotate backwards to allow the foot of the rider to be released from the stirrup more easily.

The stirrup described above has a drawback related to the eye. In this stirrup, the eye has several discrete positions relative to the arms and the foot. When the eye is moved into one of these positions, the eye is locked to the arms and the foot by a locking mechanism. Accordingly, the eye rotates when the foot of the rider turns or twists sideways in the stirrup. As the eye rotates, the strap passing through the eye twists so that the edges of the strap are turned towards and rub against the horse and the leg of the rider. This is uncomfortable for both the horse and the rider.

Another drawback of the preceding stirrup stems from the fact that the foot of the stirrup can rotate forwards as well as backwards from the central position. The foot of the rider tends to push forwards with a resultant forward rotation of the foot of the stirrup. This causes the rider to experience a certain degree of instability.

SUMMARY OF THE INVENTION

It is an object of the invention to reduce discomfort from a stirrup.

Another object of the invention is to improve the stability of a stirrup.

The preceding objects, as well as others which will become apparent as the description proceeds, are achieved by the invention.

One aspect of the invention resides in a stirrup. The stirrup comprises a carrier, a footrest on the carrier, and a holding member on the carrier for holding a strap.

In one embodiment of the stirrup, the carrier and the footrest are freely rotatable relative to the holding member at least through an angle equalling or approximating 90 degrees.

With this embodiment, the holding member can be positioned so that a strap held by the same lies flat against an animal to be ridden and flat against the leg of a rider. Inasmuch as the carrier and the footrest can rotate relative to the holding member at least through an angle of the order of 90 degrees, the carrier and the footrest can simultaneously be oriented to properly receive the foot of the rider. Moreover, the ability of the carrier and the footrest to freely rotate relative to the holding member allows the holding member to maintain its position in the event that the foot of the rider turns or twists sideways in the stirrup. This enables the strap to remain flat.

In another embodiment of the stirrup, the carrier defines a plane and the footrest is provided with a support surface for a foot. The footrest is rotatable relative to the carrier and has a preselected position in which the support surface is perpendicular to the plane. The stirrup here comprises means for restricting rotation of the footrest out of the preselected position to a single direction only.

This embodiment of the stirrup can be secured to an animal to be ridden such that the footrest can only rotate backwards from the position of perpendicularity of the carrier plane and footrest support surface. Since the footrest is unable to rotate forwards relative to the carrier, the present embodiment of the stirrup enables the foot of a rider to be supported relatively stably.

An additional aspect of the invention resides in a method of manipulating a stirrup which includes a carrier, a footrest on the carrier, and a holding member on the carrier for holding a strap One embodiment of the method comprises the steps of engaging the holding member with a strap, and freely rotating the carrier and the footrest relative to the holding member at least through an angle equalling or approximating 90 degrees. The engaging and rotating steps are performable in either order.

It was mentioned earlier that the holding member may have a holding portion which is at least approximately coplanar with the carrier in a predetermined position of the carrier and the footrest. In such an event, the instant embodiment of the method can further comprise the step of restricting rotation of the carrier and the footrest out of the predetermined position to a single direction only. This embodiment of the method may also comprise the step of restricting rotation of the carrier and the footrest in such direction to an angle equalling or approximating 90 degrees.

As outlined previously, the footrest may be rotatable relative to the carrier. Furthermore, the carrier may define a plane and the footrest may be provided with a support surface which is intended to support a foot and is at least approximately perpendicular to the carrier plane in a preselected position of the footrest. Under such circumstances, another embodiment of the method provides for restricting rotation of the footrest out of the preselected position to a single direction only.

The latter embodiment of the method can further comprise urging the footrest towards the preselected position.

The features of the different embodiments of the stirrup can be combined as can the features of the different embodiments of the method.

Additional features and advantages of the invention will be forthcoming from the following detailed description of preferred embodiments when read in conjunction with the accompanying drawings.

DESCRIPTION OF THE PREFERRED EMBODIMENTS

Figure 1:
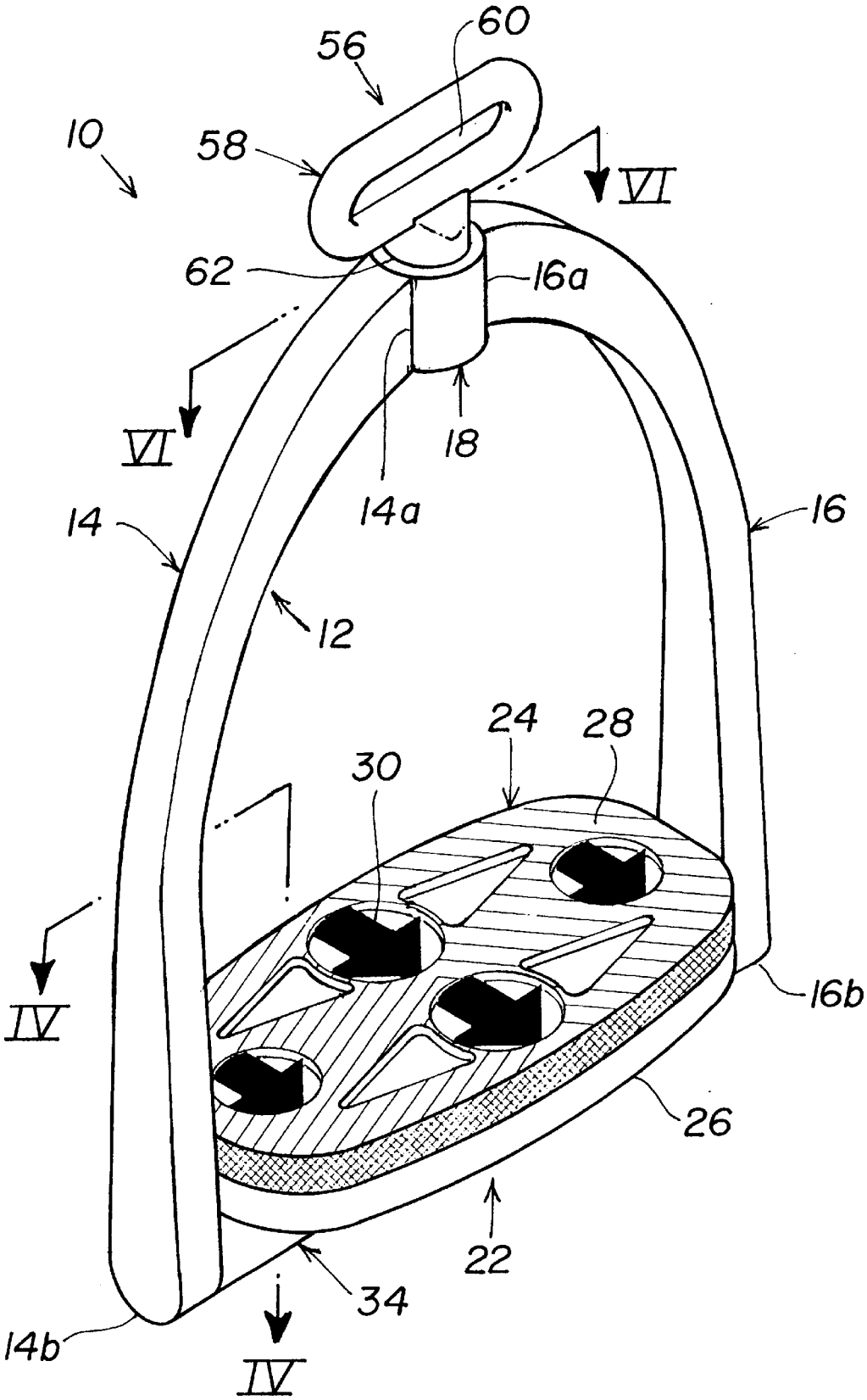
FIG. 1 is a perspective view of a stirrup in accordance with the invention in one condition.
Figure 2:
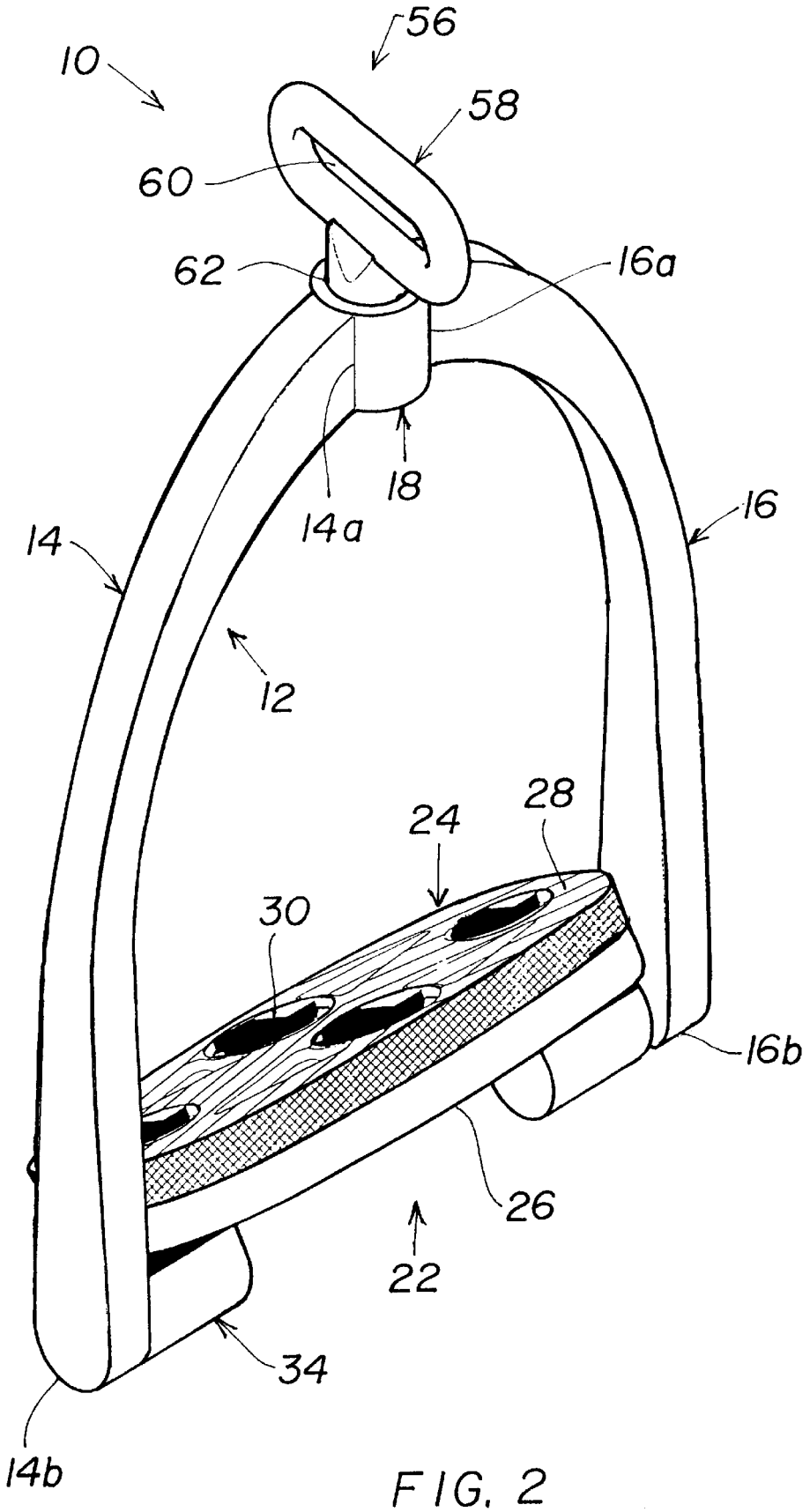
FIG. 2 is a perspective view of the stirrup of FIG. 1 in another condition.

Referring to FIGS. 1 and 2, a stirrup according to the invention is identified by the numeral 10. The stirrup 10 includes a carrier 12 made up of two curved arms 14 and 16. The arm 14 has an upper end 14*a* and a lower end 14*b* while the arm 16 has an upper end 16*a* and a lower end 16*b*. The upper end 14*a* of the arm 14 faces the upper end 16*a* of the arm 16, and the upper ends 14*a*,16*a* are connected to diametrically opposite locations of a vertical cylindrical housing 18. The upper end of the housing 18 is open whereas the lower end is closed by an end wall 20 which is visible in FIG. 6.

The lower end 14*b* of the arm 14 is spaced from the lower end 16*b* of the arm 16, and the lower ends 14*b*,16*b* face and are in line with one another. The arrangement of the arms 14,16 and housing 18 is such that the carrier 12 resembles an arch which can be considered to define a plane. This plane is vertical in FIGS. 1 and 2.

A foot or footrest 22 is rotatably mounted on the lower ends 14*b*,16*b* of the arms 14,16. The foot 22 includes a resilient tread 24 which is carried by a base 26, and the tread 24 has an upper surface 28 which serves as a support surface for the foot of a rider. The upper tread surface 28 is provided with several arrows 30 which, when the stirrup 10 is in use, should point towards the front of an animal to be ridden. Accordingly, the forward direction is the direction in which the arrows 30 point while the backward direction is the opposite direction.

In FIG. 1, the position of the foot 22 is such that the plane defined by the carrier 12 is perpendicular to the upper tread surface 28. Contrary to a conventional foot which can rotate forwards and backwards from this position relative to its carrier, the foot 22 can only rotate backwards relative to the carrier 12. FIG. 2 shows the foot 22 in a rotated position relative to the carrier 12.

Figure 3:
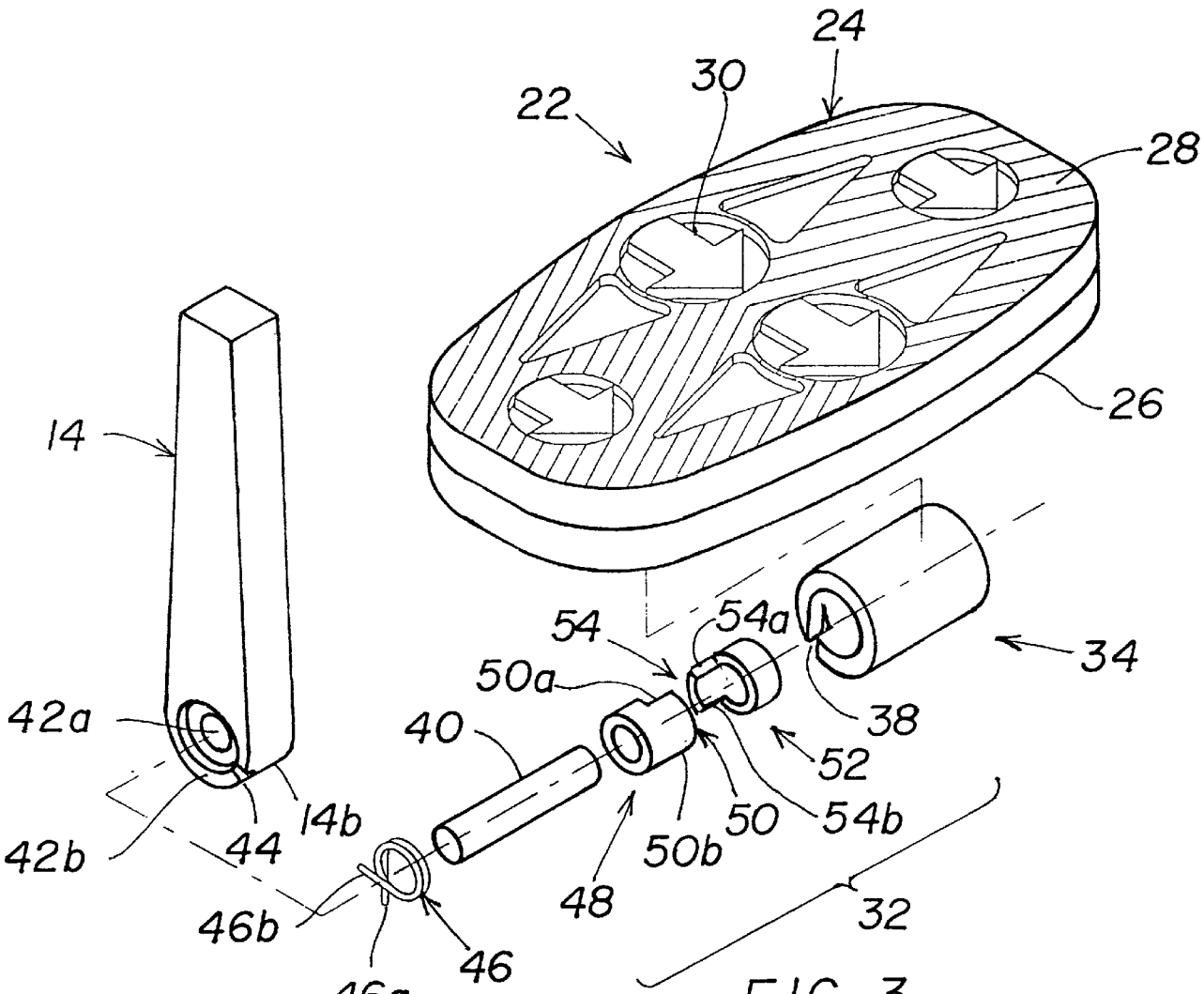
FIG. 3 is an exploded view showing the connection between a carrier and a footrest constituting part of the stirrup of FIG. 1.
Figure 4:
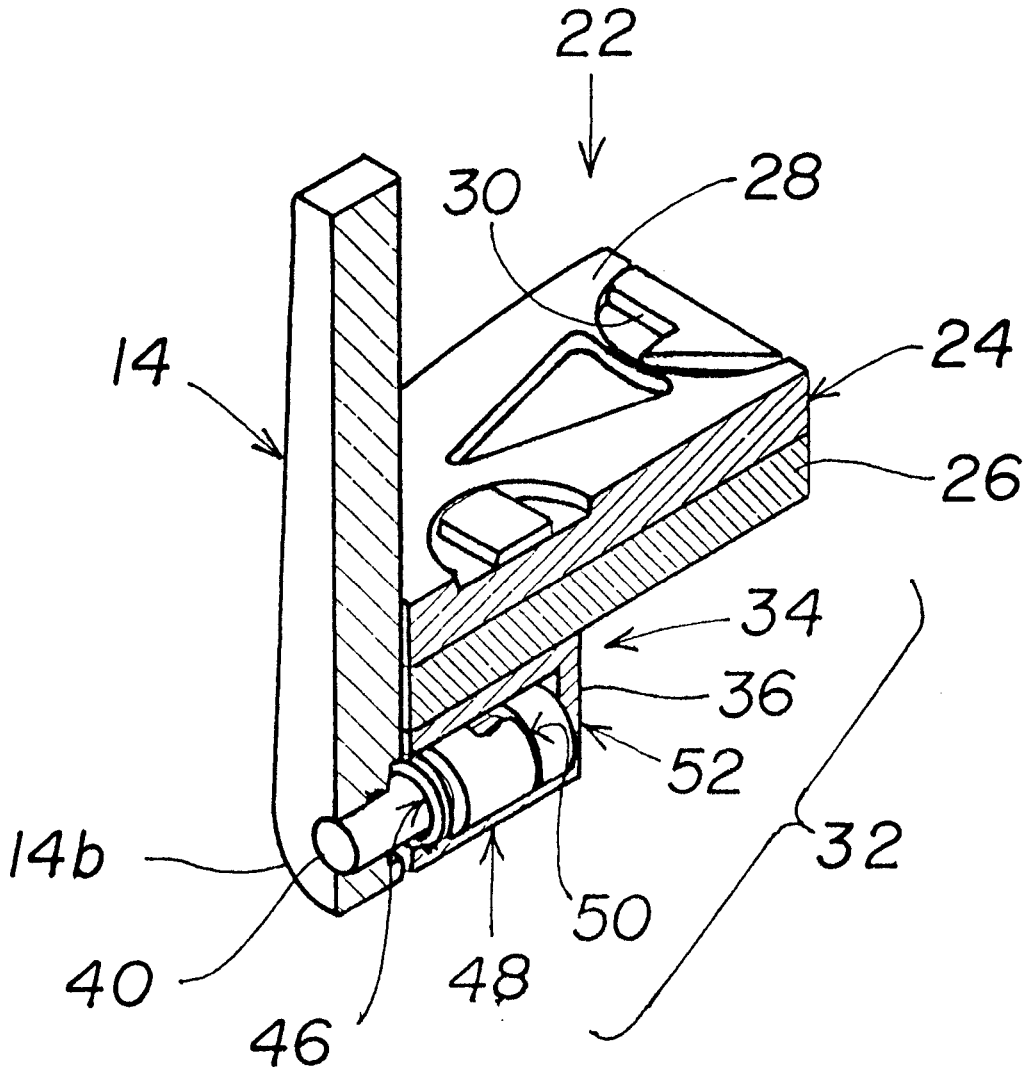
FIG. 4 is a fragmentary sectional view as seen in the direction of the arrows IV—IV of FIG. 1 and shows the connection of FIG. 3 in assembled condition.

FIGS. 3 and 4 show a connection 32 between the foot 22 and the arm 14 of the carrier 12. Since the connection between the foot 22 and the arm 16 is identical, only the connection 32 will be described.

The connection 32 includes a horizontal cylindrical housing 34 which is secured to the underside of the base 26 of the foot 22, e.g., by welding. One end of the housing 34 faces the arm 14 of the carrier 12 and is open while the other end faces the arm 16 and is closed by an end wall 36. The open end of the housing 34 is separated from the carrier arm 14 by a small gap. A notch or groove 38 is formed in the inner surface of the housing 34 adjacent the open end of the housing 34.

The connection 32 further includes a circular shaft or rod 40 which is a press fit in a narrow section 42*a* of a passage provided at the end 14*b* of the carrier arm 14. The shaft 40 projects from the passage into the housing 34. In addition to the narrow section 42*a*, the passage includes a wide section 42*b* which adjoins the narrow section 42*a*. The passage 42*a*,42*b* extends from the side of the arm 14 which faces the arm 16 towards the side of the arm 14 which faces away from the arm 16. The passage 42*a*,42*b* is open at the former side of the arm 14 and closed at the other side. The wide section 42*b* is located adjacent the side of the arm 14 which faces the arm 16.

A notch or groove 44 extends radially outward from the wide section 42*b* of the passage 42*a*,42*b* partway to the external surface of the carrier arm 14. A torsion spring or biasing element 46 surrounds the shaft 40 with clearance and sits in the wide section 42*b*. The spring 46 has two legs 46*a* and 46*b*, and the leg 46*a* is received in the notch 44 of the carrier arm 14 while the leg 46*b* is received in the notch 38 of the housing 34 secured to the foot 22. The spring 46 bears against the carrier arm 14 and the housing 34 in a sense urging the foot 22 and the carrier 12 to the position in which the plane defined by the carrier 12 is perpendicular to the upper surface 28 of the foot 22.

A bushing 48 is located inside the housing 34 with clearance and is a press fit on the shaft 40. The bushing 48, which is situated adjacent to the spring 46, is provided with an extension 50 at the end of the bushing 48 remote from the spring 46. The extension 50 constitutes a segment of a cylinder and is bounded circumferentially by a longitudinal edge 50*a* and a longitudinal edge 50*b*.

A second bushing 52 is a press fit inside the housing 34 and sits between the bushing 48 and the end wall 36 of the housing 34. The bushing 52 is formed with an extension 54 at the end of the bushing 52 facing the bushing 48. The extension 54 constitutes a segment of a cylinder and is bounded circumferentially by a longitudinal edge 54*a* and a longitudinal edge 54*b*.

The bushing 52, housing 34 and foot 22 are rotatable relative to the bushing 48, shaft 40 and carrier 12.

The extension 50 of the bushing 48 and the extension 54 of the bushing 52 overlap one another. The longitudinal edge 50*a* of the extension 50 faces the longitudinal edge 54*a* of the extension 54, and the longitudinal edges 50*a*,54*a* are arranged to abut each other when the plane defined by the carrier 12 is perpendicular to the upper surface 28 of the foot 22. Consequently, the foot 22 is unable to rotate forward relative to the carrier 12 beyond the position of perpendicularity of the upper foot surface 28 and the carrier plane.

The longitudinal edge 50*b* of the extension 50 faces the longitudinal edge 54*b* of the extension 54, and the longitudinal edges 50*b*,54*b* are spaced from one another when the carrier plane is perpendicular to the upper foot surface 28. Accordingly, the foot 22 is free to rotate backward relative to the carrier 12 from the position of perpendicularity of the upper foot surface 28 and the carrier plane. The longitudinal edges 50*b*,54*b* are arranged to come into abutment when the foot 22 has rotated backwards relative to the carrier 12 through a predetermined angle which may be selected in a conventional manner.

With reference again to FIGS. 1 and 2, an eye or holding member 56 is mounted on the carrier 12 above the housing 18. The eye 56 serves to hold a strap which is used to suspend the stirrup 10 from an animal to be ridden. The eye 56 includes an oblong portion 58 having a slot or elongated opening 60 through which a strap can be passed. The eye 56 further includes a cap-like portion 62 which extends downward from the oblong portion 58 and tapers outward on opposite sides thereof. The cap-like portion 62 is provided with a passage which is open at the end of the cap-like portion 62 remote from the oblong portion 58.

The eye 56 is rotatable relative to the carrier 12 at least through an angle of 90 degrees or approximately 90 degrees. Preferably, however, rotation of the eye 56 relative to the carrier 12 is restricted to an angle equalling or approximating 90 degrees. In the illustrated embodiment, the eye 56 and carrier 12 are rotatable relative to one another through 90 degrees between a position shown in FIG. 1 and a position shown in FIG. 2. The oblong portion 58 is coplanar with the carrier 12 in FIG. 1 and perpendicular to the carrier 12 in FIG. 2. The eye 56 can rotate freely or continuously relative to the carrier 12 between the two extreme or terminal positions, that is, there is nothing in the stirrup 10 to interfere with or retard relative movement of the eye 56 and carrier 12 from either of these positions to the other.

Figure 5:
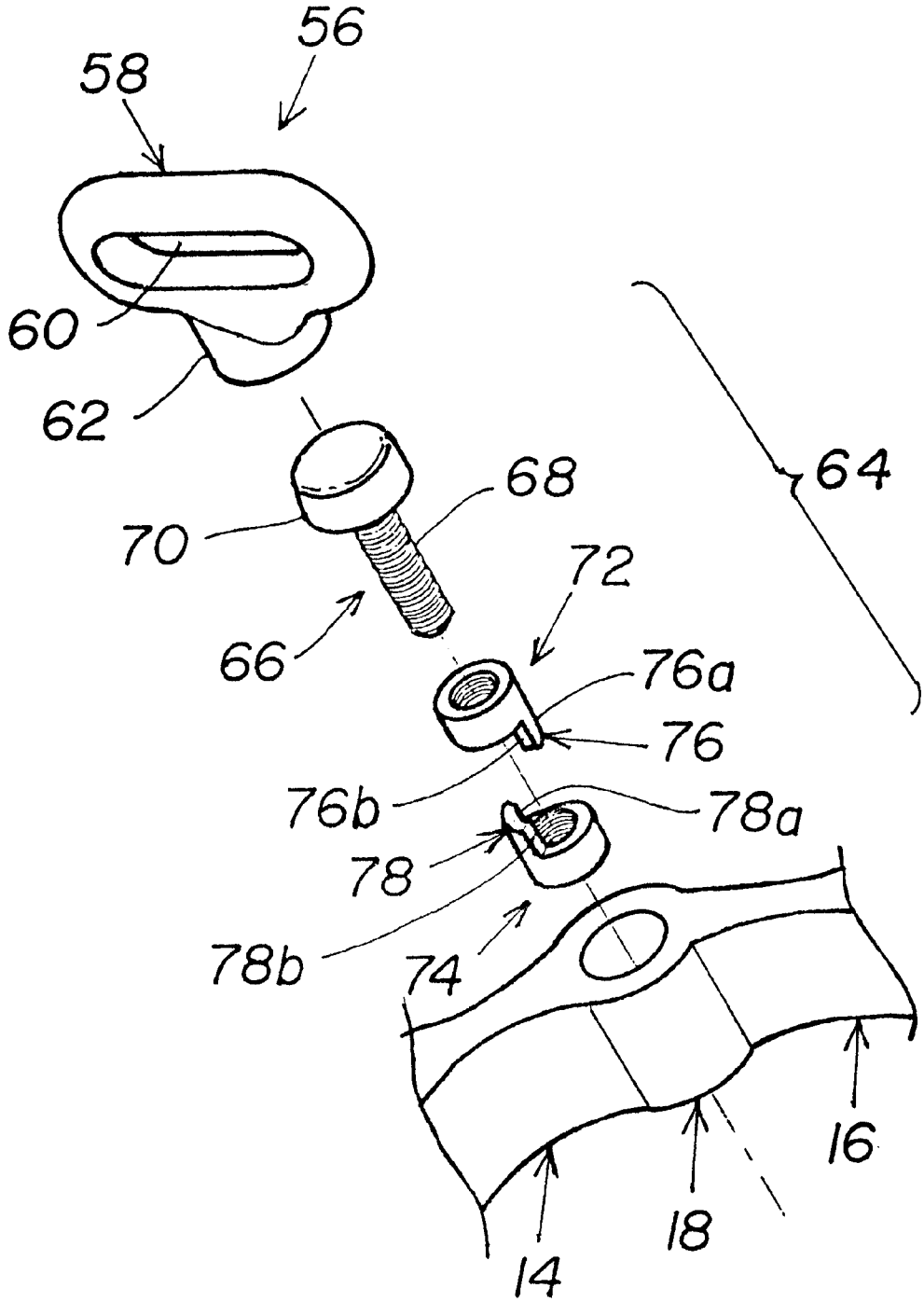
FIG. 5 is an exploded view showing the connection between the carrier of the stirrup of FIG. 1 and a strap holding member also constituting part of the stirrup.
Figure 6:
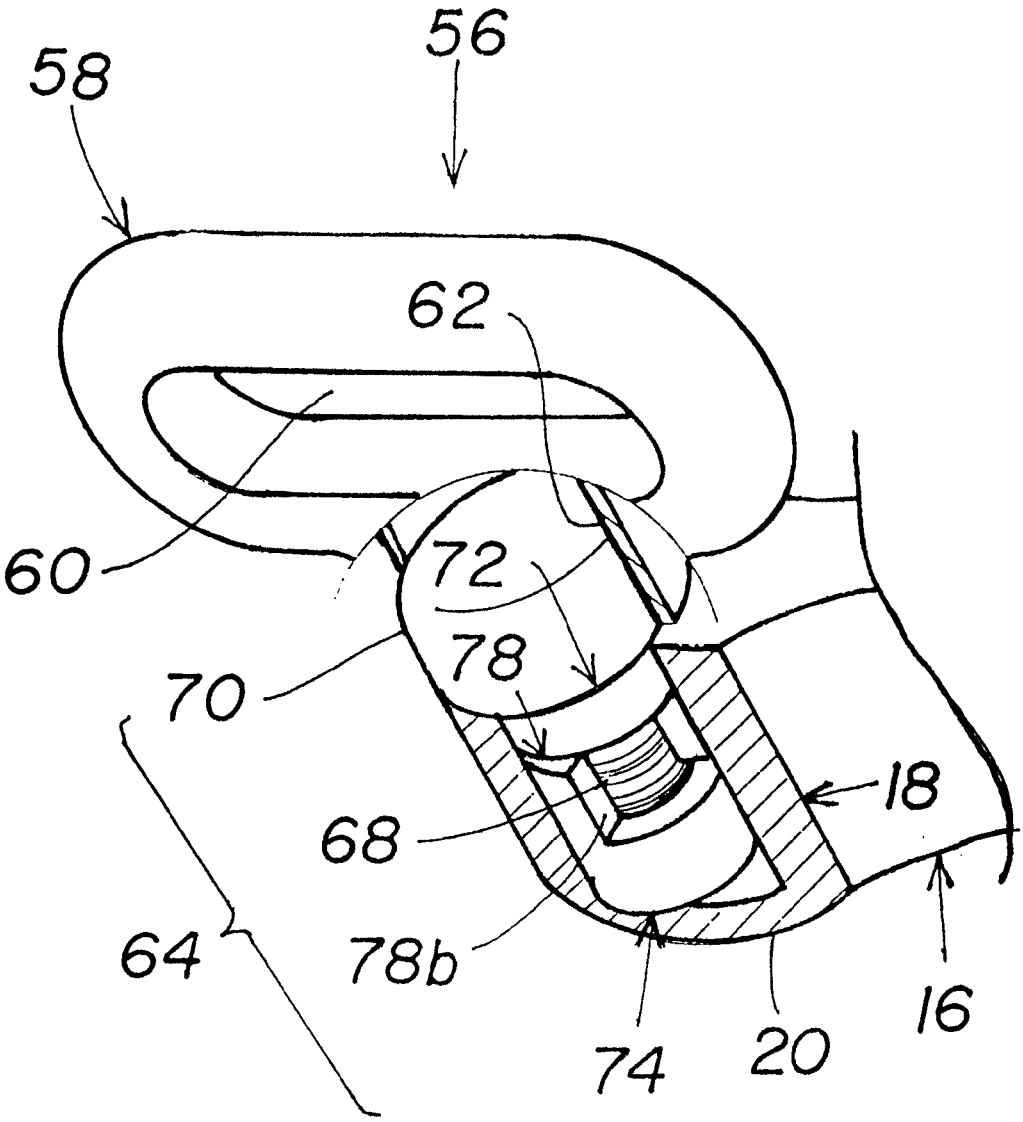
FIG. 6 is a fragmentary sectional view as seen in the direction of the arrows VI—VI of FIG. 1 and shows the connection of FIG. 5 in assembled condition.

FIGS. 5 and 6 illustrate a connection 64 between the eye 56 and the carrier 12.

The connection 64 includes a screw 66 having a threaded shank 68 and a head 70 which is a press fit in the cap-like portion 62 of the eye 56. The shank 68 extends into the housing 18 of the carrier 12, and the connection 64 further includes a nut 72 which is screwed onto the shank 68. The nut 72 is located in the housing 18 near the open end of the same and near the head 70 of the screw 66. The connection 64 also includes a nut 74 which is a press fit in the housing 18 and is situated adjacent to the end wall 20 thereof. The end of the shank 68 remote from the head 70 is screwed into the nut 74.

Assuming that the eye 56 is rotated while the carrier 12 remains stationary, the screw 66 rotates together with the nut 72 adjoining the head 70 of the screw 66. On the other hand, the nut 74 adjacent to the end wall 20 of the housing 18 remains stationary and, depending upon the direction of rotation of the eye 56, the shank 68 of the screw 66 moves somewhat deeper into the nut 74 or withdraws slightly therefrom. In general, the eye 56, screw 66 and nut 72 are rotatable relative to the nut 74 and carrier 12.

The nut 72 is provided with an extension 76 at the end of the nut 72 facing the nut 74. The extension 76 constitutes a segment of a cylinder and is bounded circumferentially by a longitudinal edge 76*a* and a longitudinal edge 76*b*.

Similarly, the nut 74 is formed with an extension 78 at the end of the nut 74 facing the nut 72. The extension 78 again constitutes a segment of a cylinder and is bounded circumferentially by a longitudinal edge 78*a* and a longitudinal edge 78*b*.

The extension 76 of the nut 72 and the extension 78 of the nut 74 overlap one another. The longitudinal edge 76*a* of the extension 76 faces the longitudinal edge 78*a* of the extension 78, and the longitudinal edges 76*a*,78*a* are designed to abut each other when the oblong portion 58 of the eye 56 is coplanar with the carrier 12. On the other hand, the longitudinal edge 76*b* of the extension 76 faces the longitudinal edge 78*b* of the extension 78, and the longitudinal edges 76*b*,78*b* are designed to come into abutment when the oblong portion 58 of the eye 56 is perpendicular to the carrier 12.

If the arrangement is such that the longitudinal edges 76*a*,78*a* come into abutment in response to counterclockwise rotation of the eye 56 relative to the carrier 12, no further counterclockwise rotation of the eye 56 can occur following abutment. At this time, the oblong portion 58 of the eye 56 is coplanar with the carrier 12. In this position, the longitudinal edge 76*b* of the extension 76 is spaced from the longitudinal edge 78*b* of the extension 78 so that the eye 56 is free to rotate clockwise relative to the carrier 12.

The spacing between the longitudinal edges 76*b*,78*b* is such that the longitudinal edges 76*b*,78*b* come into abutment when the eye 56 has been rotated clockwise 90 degrees relative to the carrier 12. The oblong portion 58 of the eye 56 is then perpendicular to the carrier 12. Additional clockwise rotation of the eye 56 is prevented although the eye 56 is free to rotate counterclockwise relative to the carrier 12 since the longitudinal edges 76*a*,78*a* are now spaced from one another.

Assuming that the oblong portion 58 of the eye 56 is coplanar with the carrier 12, the operation of the stirrup 10 is as follows:

The stirrup 10 is placed next to the body of an animal to be ridden with the slot 60 of the eye 56 facing the body. A free end of a strap attached to the animal is passed through the slot 60, and the free end of the strap is secured to suspend the stirrup 10 from the animal. The strap is arranged to lie flat against the animal. The carrier 12 and foot 22 are thereupon rotated to a position in which the stirrup 10 can receive the foot of a rider. In this regard, care should be exercised when positioning the stirrup 10 next to the animal so that the arrows 30 on the foot 12 point forwards following rotation of the carrier 12 and foot 22.

Once the carrier 12 and foot 22 have been rotated, the rider mounts the animal and, in the process, places her or his foot on the foot 22 of the stirrup 10.

If the upper surface 28 of the foot 12 is perpendicular to the carrier plane and the rider exerts backward pressure on the foot 22 while mounting or riding the animal, the foot 22 rotates backwards relative to the carrier 12 against the action of the spring 46. Upon rotation of the foot 22 relative to the carrier 12, the upper foot surface 28 is no longer perpendicular to the carrier plane. When the backward pressure is released, the spring 46 returns the foot 22 to the position of perpendicularity of the upper foot surface 28 and the carrier plane.

In contrast, should the rider exert forward pressure on the foot 22 when the upper foot surface 28 is perpendicular to the carrier plane, the foot 22 remains fixed relative to the carrier 12. Consequently, the stability of the rider is enhanced.

In the event that the foot of the rider turns or twists sideways while the eye 56 and the carrier 12 are between their terminal positions, the carrier 12 rotates with the foot of the rider. However, the eye 56 remains in position because the carrier 12 can rotate freely relative to the eye 56. Hence, the strap which passes through the eye 56 remains flat rather than twisting so that the edges thereof rub against and irritate the animal and the leg of the rider.

In the preceding description of the operation of the stirrup 10, it was assumed that the oblong portion 58 of the eye 56 was coplanar with the carrier 12 when the strap was passed through the eye 56. In this case, the carrier 12 and foot 22 are rotated to a position in which the stirrup 10 can receive the foot of the rider after passing the strap through the eye 56. Alternatively, the carrier 12 and foot 22 can be rotated to this position before passing the strap through the eye 56 and then held in such position while the strap is passed through the eye 56.

The stirrup 10 can be used for a horse as well as for other animals which can be ridden.

Various modifications are possible within the meaning and range of equivalence of the appended claims.

I claim:

1. A stirrup comprising:

a carrier;

a footrest on said carrier; and a holding member on said carrier for holding a strap, said carrier and said footrest being freely rotatable relative to said holding member;

wherein said holding member has a holding portion which is at least approximately coplanar with said carrier in a predetermined position of said carrier and said footrest; and further comprising-means for limiting rotation of said carrier and said footrest relative to said holding member, said limiting means including means for restricting rotation of said carrier and said footrest in a single direction only out of said predetermined position to an angle at least equalling or approximating 90 degrees.

2. The stirrup of claim 1, wherein said carrier defines a plane and said footrest has a support surface for a foot, said footrest having one position in which said support surface is at least approximately perpendicular to said plane; and further comprising means for limiting rotation of said footrest relative to said carrier, said limiting means including means for restricting rotation of said footrest out of said one position to a single direction only.

3. The stirrup of claim 2, further comprising means for urging said footrest towards said one position.

4. A stirrup comprising:

a carrier defining a plane;

a holding member on said carrier for holding a strap;

a footrest on said carrier rotatable relative to said carrier at least through an angle equalling or approximating 90 degrees and having a support surface for a foot, said footrest having one position in which said support surface is at least approximately perpendicular to said plane; and means for limiting rotation of said footrest relative to said carrier, said limiting means including means for restricting rotation of said footrest out of said one position to a single direction only;

wherein said carrier and said footrest are rotatable relative to said holding member, said holding member having a holding portion which is at least approximately coplanar with said carrier in a predetermined position of said carrier and said footrest; and further comprising means for limiting rotation of said carrier and said footrest relative to said holding member, said limiting means including means for restricting rotation of said carrier and said footrest in said direction to an angle equalling or approximating 90 degrees.

5. The stirrup of claim 4, further comprising means for urging said footrest towards said one position.

6. A method of manipulating a stirrup which includes a carrier, a footrest on said carrier, and a holding member on said carrier for holding a strap, wherein said holding member has a holding portion which is at least approximately coplanar with said carrier in a predetermined position of said carrier and said footrest, said method comprising the steps of:

engaging said holding member with a strap;

freely rotating said carrier and said footrest relative to said holding member at least through an angle equalling or approximating 90 degrees, the engaging and rotating steps being performable in either order;

rotating said footrest relative to said carrier;

restricting rotation of said carrier and said footrest out of said predetermined position to a single direction only; and restricting rotation of said carrier and said footrest in said direction to an angle equalling or approximating 90 degrees.

7. The method of claim 6, wherein said carrier defines a plane and said footrest has a support surface for a foot, said footrest having one position in which said support surface is at least approximately perpendicular to said plane; and further comprising the step of restricting rotation of said footrest out of said one position to a single direction only.

8. The method of claim 6, further comprising the step of urging said footrest towards said one position.

9. A method of manipulating a stirrup which includes a carrier defining a plane, a footrest on said carrier having a support surface for a foot, and a holding member on said carrier for holding a strap, said footrest having one position in which said support surface is at least approximately perpendicular to said plane, said method comprising the steps of:

restricting rotation of said footrest out of said one position to a single direction only;

freely rotating said carrier and said footrest relative to said holding member at least through an angle equalling or approximating 90 degrees;

engaging said holding member with a strap;

rotating said carrier and said footrest relative to said holding member, the engaging and rotating steps being performable in either order; and restricting rotation of said carrier and said footrest out of a predetermined position to a single direction only to an angle equalling or approximating 90 degrees, said holding member having a holding portion which is at least approximately coplanar with said carrier in said predetermined position.

10. The method of claim 9, further comprising the step of urging said footrest towards said one position.

* * * * *